US009901158B2

(12) United States Patent
Endou et al.

(10) Patent No.: US 9,901,158 B2
(45) Date of Patent: Feb. 27, 2018

(54) LIQUID SUBSTANCE ADVANCING CONTAINER

(71) Applicant: MITSUBISHI PENCIL COMPANY, LIMITED, Tokyo (JP)

(72) Inventors: Mitsuru Endou, Gunma (JP); Atsushi Nakashima, Gunma (JP); Nobuyuki Nakajima, Gunma (JP); Yuusuke Kyogoku, Gunma (JP); Tetsuaki Akaishi, Gunma (JP); Hiroshi Satou, Gunma (JP); Yukako Shinmura, Gunma (JP); Hisami Tamano, Gunma (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 84 days.

(21) Appl. No.: 14/769,659

(22) PCT Filed: Feb. 25, 2014

(86) PCT No.: PCT/JP2014/054430
§ 371 (c)(1),
(2) Date: Aug. 21, 2015

(87) PCT Pub. No.: WO2014/129645
PCT Pub. Date: Aug. 28, 2014

(65) Prior Publication Data

US 2016/0007715 A1 Jan. 14, 2016

(30) Foreign Application Priority Data

Feb. 25, 2013 (JP) ..... 2013-034730
Feb. 19, 2014 (JP) ..... 2014-029446

(51) Int. Cl.
*A45D 34/04* (2006.01)

(52) U.S. Cl.
CPC ..... *A45D 34/04* (2013.01); *A45D 34/042* (2013.01); *A45D 2200/055* (2013.01)

(58) Field of Classification Search
CPC combination set(s) only.
See application file for complete search history.

(56) References Cited

U.S. PATENT DOCUMENTS 5,100,252 A * 3/1992 Podolsky ..... A46B 11/0027 401/174
5,653,338 A * 8/1997 Tani ..... A45D 40/04 206/385

(Continued)

FOREIGN PATENT DOCUMENTS

FR 2 825 904 A1 12/2002
JP 63-3311 1/1988

(Continued)

OTHER PUBLICATIONS

Extended European Search Report dated Sep. 9, 2016 for corresponding European Application No. 14753988.6.

(Continued)

*Primary Examiner* — David Walczak
(74) *Attorney, Agent, or Firm* — Renner, Otto, Boisselle & Sklar, LLP

(57) ABSTRACT

The liquid substance advancing container is constructed such that the piston is formed of a sealing part in a front part of the piston that comes in sliding contact with an inner wall of a reservoir of the barrel body and a bar member in the rear part of the piston that has a threaded section on the inner or outer periphery, is movable in a axial direction and is restrained form moving with respect to the rotational direction, a front bar-like part extended forward from the handle is formed with a threaded section that is directly or indirectly screw-fitted to the threaded section of the bar member in the rear part of the piston, and, as the handle is rotated relative (Continued)

to the barrel body, the piston advances and then after full advance of the piston the front bar-like part can extend and retract by multiple stages.

10 Claims, 14 Drawing Sheets

(56) References Cited

U.S. PATENT DOCUMENTS

| | | | | |
|---|---|---|---|---|
| 7,901,152 | B2 * | 3/2011 | Hines | A47L 25/08 401/172 |
| 8,172,472 | B2 * | 5/2012 | Tani | A45D 40/04 222/390 |
| 8,936,408 | B2 | 1/2015 | Fukumoto et al. | |
| 2009/0154984 | A1 | 6/2009 | Tani | |
| 2012/0039661 | A1 | 2/2012 | Fukumoto et al. | |

FOREIGN PATENT DOCUMENTS

| | | | |
|---|---|---|---|
| JP | 2004-160117 | A | 6/2004 |
| JP | 2007-029536 | A | 2/2007 |
| JP | 2007-130438 | A | 5/2007 |
| JP | 2007-143857 | A | 6/2007 |
| JP | 2008-043590 | A | 2/2008 |
| JP | 2009-247427 | A | 10/2009 |
| JP | 2010-227553 | A | 10/2010 |
| JP | 2012-115684 | A | 6/2012 |
| WO | WO 2013/015533 | A2 | 1/2013 |

OTHER PUBLICATIONS

International Search Report for corresponding International Application No. PCT/JP2014/054430 dated Apr. 22, 2014.
English Translation of International Preliminary Report on Patentability for corresponding International Application No. PCT/JP2014/054430 dated Sep. 3, 2015.
Notification of Reasons for Refusal for corresponding JP application 2014-029446 dated Jun. 14, 2017. English language translation.

* cited by examiner

LIQUID SUBSTANCE ADVANCING CONTAINER

TECHNICAL FIELD

The present invention relates to a liquid substance advancing container that stores a liquid or a liquid substance such as a fluid (liquid substance) cosmetic, chemical or the like, in a reservoir of the barrel body and sends out the stored liquid substance to an applying part by advancing operation by turning a tail end.

BACKGROUND ART

Conventionally, in the liquid substance advancing container represented by Japanese Patent Application Laid-open 2010-227553 (:Patent Document 1), a piston is moved forward by advancing operation rotating a tail end so as to be able to deliver the liquid substance inside the barrel body. However, this liquid substance advancing container cannot store a large amount of liquid substance because a large proportion of the barrel body is occupied by the advancing mechanism including the piston.

To deal with this, there has been a disclosure of an applicator that can advance a piston in two stages to increase the amount of stored liquid.

PRIOR ART DOCUMENTS

Patent Documents

Patent Document 1:
Japanese Patent Application Laid-open 2010-227553
Patent Document 2:
Japanese Patent Application Laid-open 2007-143857

SUMMARY OF THE INVENTION

Problems to be Solved by the Invention

The above Patent Documents 1 and 2 both provide a configuration in which a convexo-concave arrangement for anti-rotation in sliding is provided between the barrel cylinder and the piston.

In particular, in the liquid substance advancing container of Patent Document 1, an indentation and a projection are formed in the barrel body and in the rear part of the proton, respectively so that the piston will not be rotated unintentionally by rotating force in the rotational direction of the piston when its rotational body is operated for advancement.

However, in the technology of Patent Document 1, the indentation of the barrel body needs to be formed equal in the axial direction to the moving distance of the piston or longer while the barrel body is likely to deform (distort) due to shrinkage after molding because the cross-section of the barrel taken on the axis of the barrel is not formed with uniform thickness, and the cost for die machining tends to be high.

In the applicator of Patent Document 2, convexo-concave arrangements for anti-rotation are used between individual parts and many screw-fittings are used, which causes a possibility of complication of die machining, difficulty in keeping up molding stability and complicated assembly, indicating a costly container configuration.

It is therefore an object of the present invention to provide a liquid substance advancing container that is free from the problem of piston advancing operation, can be increased in the amount of liquid content in the barrel cylinder and can be configured in low cost by an easily machined die with a lower number parts.

Means for Solving the Problems

The present invention resides in a liquid substance advancing container that stores a liquid content in a reservoir provided in a barrel body, moves a piston in the reservoir forward by turning a handle of a rotational body exposed from a rear end of the barrel body, relative to the barrel body, to advance the content to a front end of the barrel body, wherein the piston is formed of a sealing part in a front part of the piston that comes in sliding contact with an inner wall of the reservoir of the barrel body and a bar member in a rear part of the piston that has a threaded section on an inner periphery or an outer periphery, is movable in an axial direction and is restrained from moving with respect to a rotational direction, a front bar-like part extended forward from the handle is formed with a threaded section that is directly or indirectly screw-fitted to the threaded section of the bar member in the rear part of the piston, and, as the handle is rotated relative to the barrel body, the piston advances and then after full advance of the piston the front bar-like part can extend and retract by multiple stages.

In the present invention, it is preferable that the bar member in the rear part of the piston together with the sealing part is movable in a front to rear direction and restrained from moving in an rotational direction, relative to the inner wall of the reservoir, and, the piston makes an outer peripheral surface of the sealing part in the front part of the piston come into sliding contact with the inner wall of the reservoir of the barrel body, is movable in the axial direction and is retained by a frictional force so as not to easily rotate in the rotational direction.

In the present invention, it is also preferable that the piston makes the sealing part in the front part of the piston come into sliding contact with the inner wall of the reservoir of the barrel body with an appropriate amount of interference in order to prevent leakage of the liquid content, and is retained by the frictional force generated by the interference so as not to easily rotate in a circumferential direction.

In the present invention, it is preferable that a threaded section is formed on an outer periphery or an inner periphery of the bar member in the rear part of the piston, the front bar-like part extended forward from the handle of the rotational body is formed with the threaded section that is directly or indirectly screw-fitted to the threaded section of the bar member in the rear part of the piston, and a blank section with no thread is provided in any one end of the bar member and the front bar-like part in which threaded sections thereof are screw-fitted to each other.

In the present invention, it is also preferable that the threaded section is formed on the outer periphery or the inner periphery of the bar member in the rear part of the piston, the front bar-like part extended forward from the handle of the rotational body is formed with the threaded section that is directly or indirectly screw-fitted to the threaded section of the bar member in the rear part of the piston, and, a slit that separates the threaded section is formed in one end of the front bar-like part and/or the rotational body.

In the present invention, it is preferable that the slit is formed in close proximity to the inner peripheral surface of the barrel body.

In the present invention, it is also preferable that an elastic part is provided between the rotational body and the front bar-like part.

Advantages of the Invention

According to the liquid substance advancing container or the present invention, the front bar-like part extended forward from the handle is formed with the threaded section that is directly or indirectly screw-fitted to the threaded section of the bar member in the rear part of the piston, and, as the handle is rotated relative to the barrel body, the bar member of the piston advances and after full advance of the bar member, the front bar-like part can extend and retract by multiple stages. Accordingly, the advance of the piston is limited by the length of the bar member but the piston can be further moved forward by the advance of the front bar-like part, so that it is possible to push out the liquid in an amount equal to or greater than the length of the piston bar member. Thus, this configuration produces excellent advantage that a greater amount of liquid content can be stored in the reservoir.

Further, prevision of the elastic part between the inner surface of the rotational body and the front bar-like part makes it possible to suppress the torque arising at the time of start of advancing and assure easy advance.

MODE FOR CARRYING OUT THE INVENTION

Next, the embodiments of the present invention will be described with reference to the accompanying drawings.

FIGS. 1 to 6 are illustrative diagrams of a liquid substance advancing container according to the first embodiment of the present invention.

Figure 1:
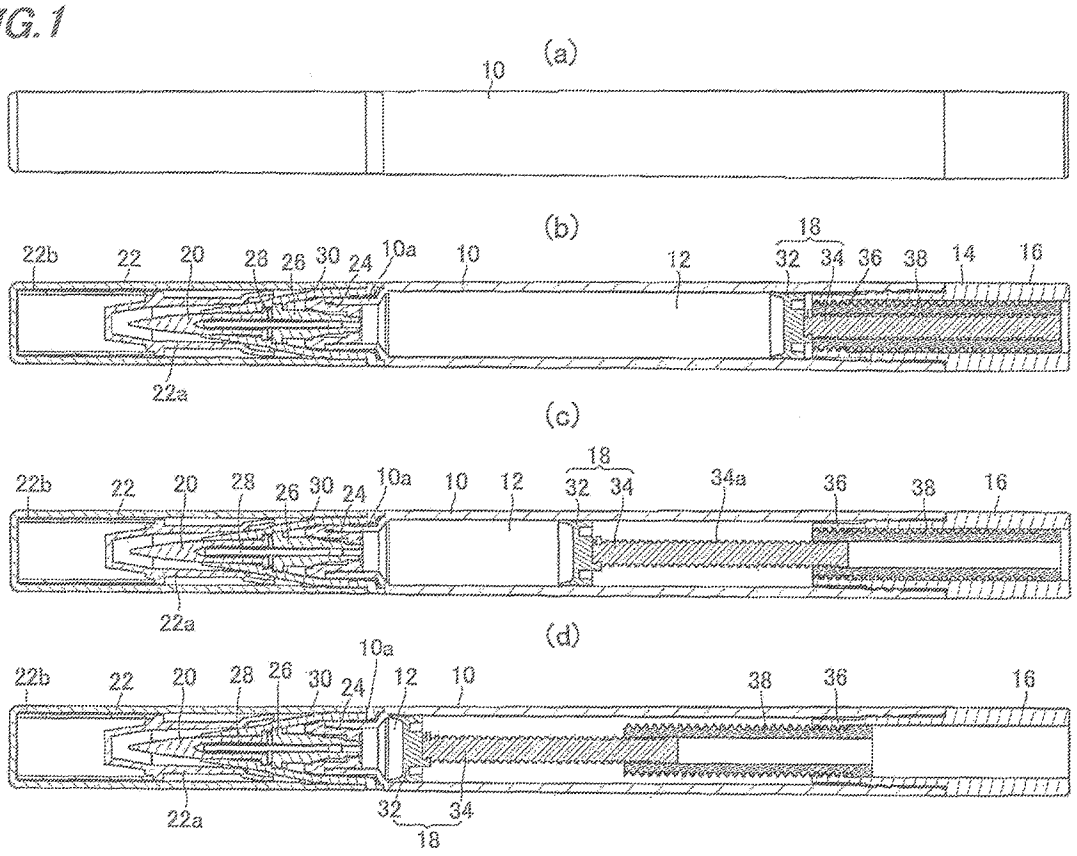
FIG. 1 is an illustrative diagram showing states of a liquid substance advancing container with a cap provided according to the first embodiment of the present invention, (a) a side view, (b) vertical section at the start of advancing, (c) vertical section during advancing and (d) vertical section at the end of advancing.
Figure 2:
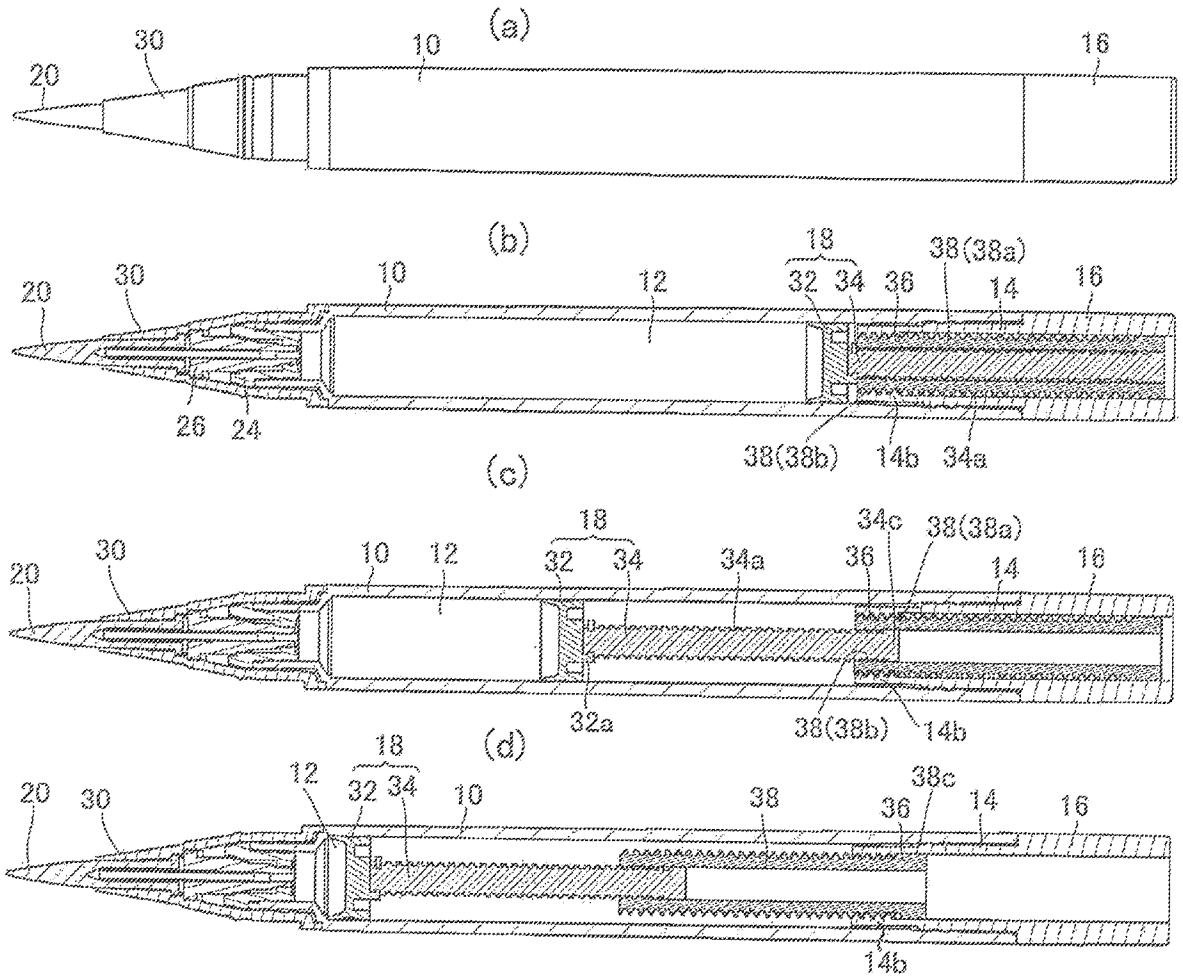
FIG. 2 is an illustrative diagram showing states of the liquid substance advancing container with the cap removed according to the first embodiment of the present invention, (a) a side view, (b) vertical section at the start of advancing, (c) vertical section during advancing and (d) vertical section at the end of advancing.

FIGS. 1 and 2 show the illustrate diagrams of a liquid substance advancing container according to the first embodiment, FIG. 1 a state with the cap put on and FIG. 2 a state with the cap removed.

As shown in FIGS. 1 and 2, the liquid substance advancing container stores a liquid substance in a reservoir 12 formed in a barrel body 10 and advances a piston 18 inside the reservoir 12 by rotating, relatively so a barrel body 10, a handle 16 of a rotational body 14 exposed from a rear end of the barrel body 10 to deliver the liquid substance toward an applying part 20 at a front end of the barrel body 10.

The front end of the barrel body 10 is detachable attached with a cap 22. When the liquid substance advancing container is not used, the front end is covered with the cap 22 as shown in FIG. 1 so that the liquid substance in the applying part 20 is prevent from drying, whereas when in use the cap 22 is removed so that applying part 20 is advanced.

As shown in FIG. 1, in the liquid substance advancing container, a seal ball receiver 24, a pipe joint 26, a pipe 28, a front barrel 30 and the applying part 20 are attached to the front end 10*a* of the barrel body 10, so that the liquid substance advanced from the reservoir 12 is delivered through the pipe 28 to the front end of the applying part 20.

The front end 10*a* of the barrel body 10 as stepped to be smaller in diameter than the middle part. The cylindrical seal ball receiver 24 is fitted and inserted into the front end 10*a*. An unillustrated seal ball is fitted in the rear of this seal ball receiver 24 while the pipe joint 26 is attached at the front part of the seal ball receiver. The pipe 28 is attached in front of the pipe joint 26. This pipe 28 is fitted into the applying part 20 of a brush from a rear end of the applying part 20.

The pipe joint 26 and the hollow conduit of the pipe 28 are made to communicate with the applying part 20. When the seal ball has fitted in the seal ball receiver 24, communication of the hollow conduit with the reservoir 12 is closed by the seal ball. The seal ball receiver 24 has an unillustrated engagement structure for the seal ball. When the engagement structure is released at the start of use, the seal ball is made to fall into the reservoir 12 so that the liquid substance is supplied through the pipe joint 26 and the pipe 28 to the applying part 20.

The front barrel 30 tapered or reduced in diameter toward the front, covers the rear part of the applying part 20, the pipe 28, the pipe joint 26 and the seal ball receiver 24 and is fitted to the front end 10*a* of the barrel body 10. An interlocking arrangement is formed on the inner peripheral surface of the front barrel 30 and the outer peripheral surface of the front end 10*a* of the barrel body 10 so as to tightly fix one to another (see FIGS. 1 and 2).

Further, the front barrel is formed so as to have the cap 22 containing an inner cap 22*a* and inner cap spring 22*b* fitted after use of the applicator, as shown in FIG. 1. When the cap 22 is used, the cap 22 covers the front barrel 30 whine the inner cap 22*a* encloses the front barrel 30 and the applying part 20 by virtue of the urging force of the inner cap spring 22*b* so as to keep the applying part 20 air-tight and prevent the applying part 20 from drying.

Moreover, when the applicator is unused, the seal ball is fitted in seal ball receiver 24, and the seal ball is plunged into the reservoir 12 at the start of use so as to establish communication between the reservoir 12 and the pipe 28. An agitating ball may be put inside the reservoir 12 so as to agitate the content liquid substance by shaking the liquid substance advancing container up and down.

The piston 18 is formed of a sealing part 32 at the front (outer peripheral) and a bar member 34 in the rear part. Sealing part 32 comes in sliding contact with the inner wall of the reservoir 12 of the barrel body 10. The bar member 34 has a threaded section on the inner periphery or outer periphery and is arranged to be movable in the axial direction and restrained from moving in the rotational direction.

A front bar-like part 36 extended forward from the handle 16 is formed with a threaded section that directly screw-fitted to the threaded section of the bar member 34 in the rear part of the piston 18.

In the first embodiment, the front bar-like part 36 of the rotational body 14 is a thick cylindrical body that is screw-fitted to the interior side of the front part of the handle 16 and extended forward. This front bar-like part 36 is formed with a threaded section 38 (female threaded section 38*b*) into which the threaded section 34*a* of the bar member 34 in the rear part of the piston 18 is screw-fitted.

Figure 6:
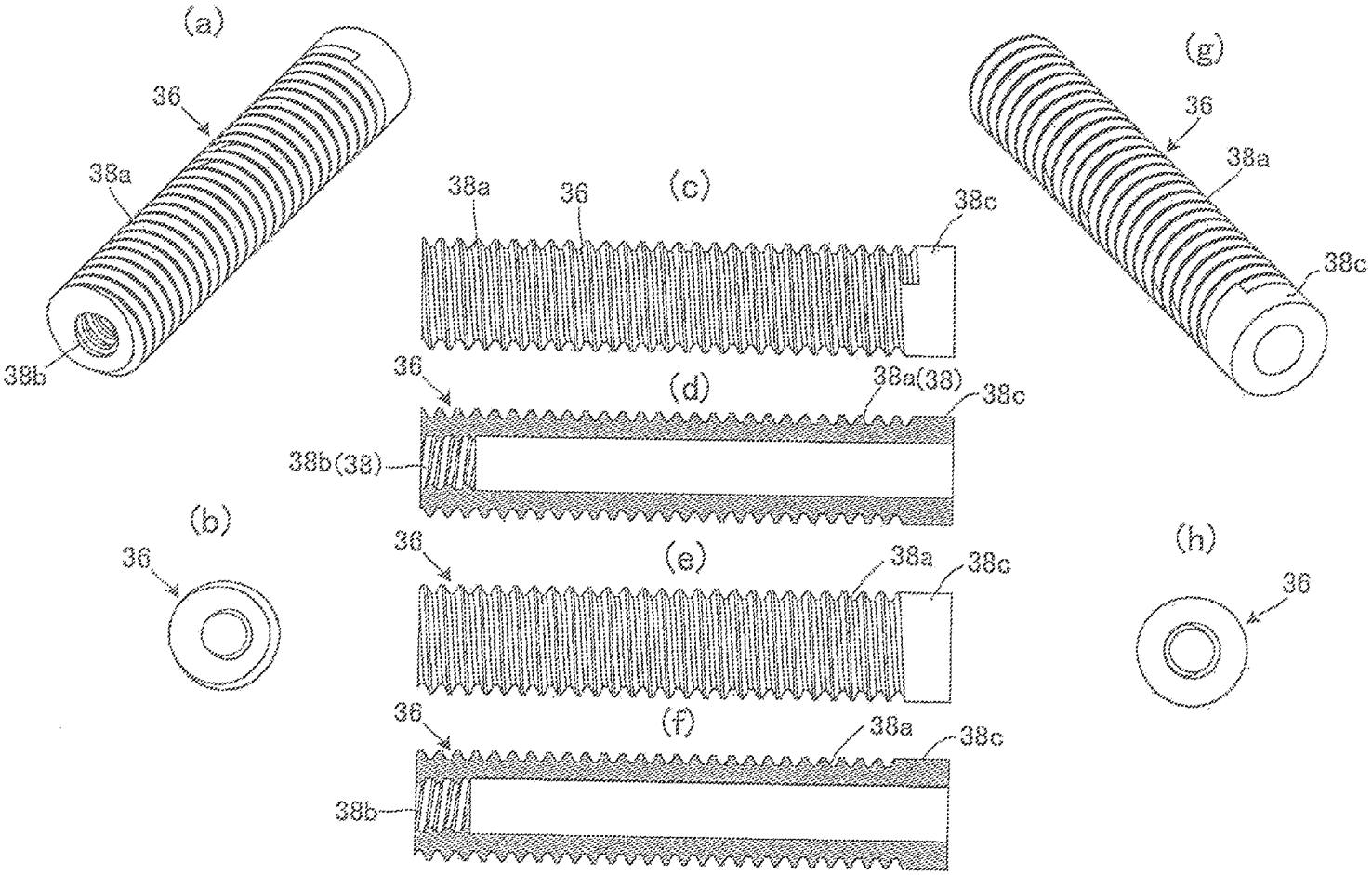
FIG. 6 is an illustrative diagram of a front bar-like part (thick thread) that is located between the bar member of the piston and the rotational body to be screwed with the thread of each in the liquid substance advancing container according to the first embodiment, (a) a perspective view from the front, (b) a view from the front, (c) a side view, (d) a vertical section, (e) a side view from another angle, (f) a vertical section of (e), (g) a perspective view from the rear, and (h) a view from true rear.

Specifically, the front bar-like part 36 screw-fitted to the rotational body 14 is formed with threaded sections 38 (male thread 38*a* and female thread 38*b*) on both the inner and outer peripheral surfaces, as shown in FIG. 6. That is, the threaded section 38*a* of the male thread on the outer peripheral surface is formed so as to be screw-fitted to the threaded, section 14*b* of the female thread while the female thread 38*b* into which the treaded portion 34*a* is screw-fitted is formed on the inner surface. The threaded section 38*a* of the male thread on the outer periphery of the front bar-like part 36 is continuously extended from the front end of the front bar-like part 36 to the vicinity of the rear end. The rear end of the front bar-like part 36 forms a blank section 38*c* without any thread.

The threaded section 14*b* of the rotational body 14 may be formed with slits that separate the thread (a configuration of the threaded section 14*b* formed wish slits 14*c* will be described in the following third embodiment (see FIG. 12)).

Accordingly, the threaded section 14*b* of the rotational body 14 (handle 16) is indirectly screw-fitted to the threaded section 34*a* of bar member 34 via the threaded section 38 of the front bar-like part 36, as shown in FIG. 2.

The sliding friction of screw fitting between the threaded section 34*a* of the bar member 34 fixed to the piston 18 and the inner threaded section 38*b* of the front bar-like part 36 is set so as to be smaller than the sliding friction of screw fitting between the outer threaded section 38*a* of the front bar-like part 36 and the threaded section 14*b* of the rotational body 14.

As the handle 16 is rotated relative to the barrel body 10 from a state shown in FIG. 2(*b*), the bar member 34 of the piston 18 moves forward thanks to the aforementioned difference in sliding friction, hence the sealing part 32 advances. Since the bar member 34 is locked by the front bar-like part 36 after the forward movement of the piston 18 at the stage shown in FIG. 2(*c*), a further rotation of the handle 16 causes the front bar-like part 36 to advance relative to the rotational body 14 and further move the sealing part 32 forward. Thus, this mechanism provides a multi-stage extending and retracting configuration as shown in FIGS. 2(*b*) to 2(*d*). Though the rotational body 14 is formed to be hollow inside with its tail end open herein, a closing plug may be fitted so as to hide the interior for improvement in design.

Herein, the above piston 18 has a structure in which the sealing part 32 and the bar member 34 are joined.

Figure 3:
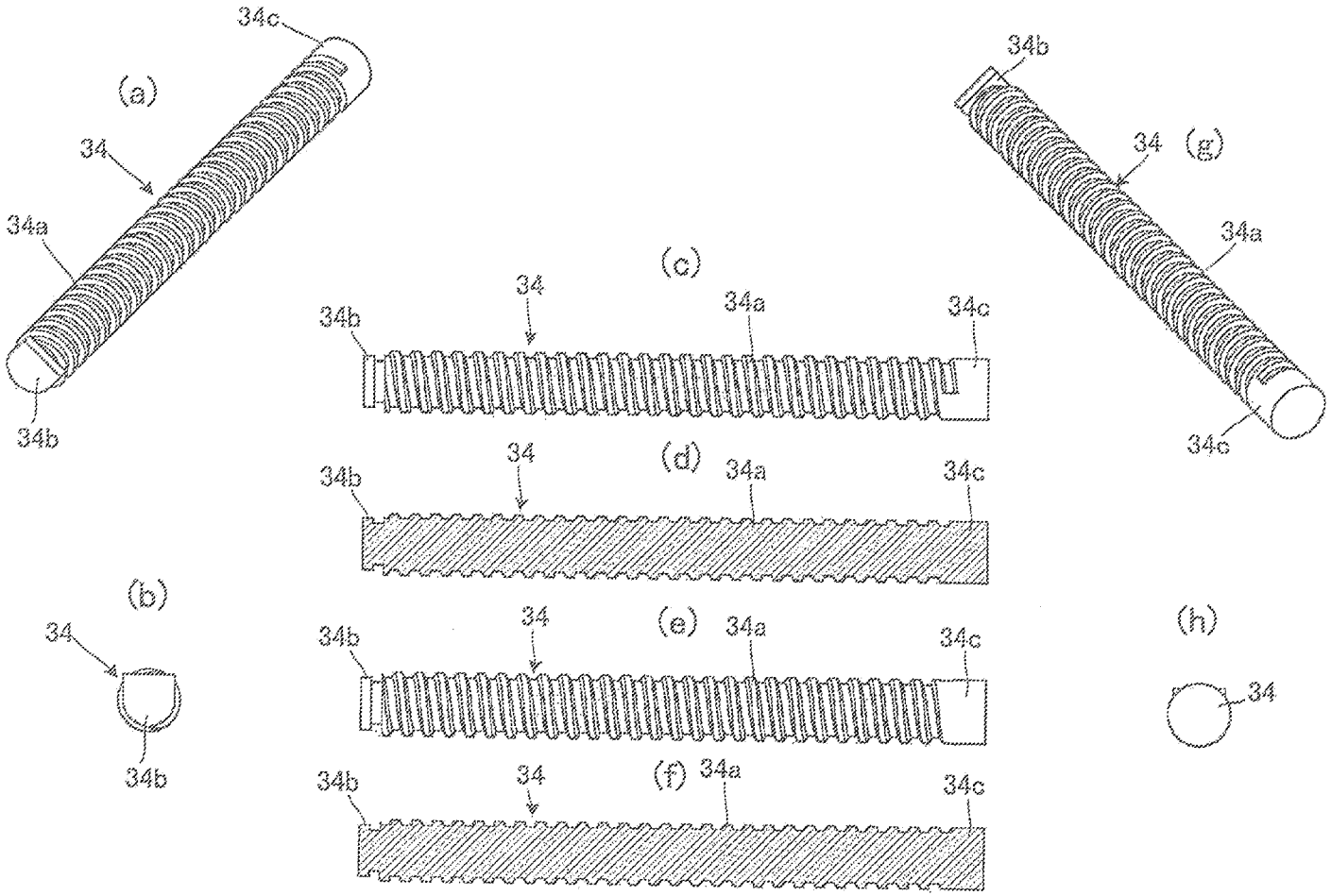
FIG. 3 is an illustrative diagram of a bar member of a piston in the liquid substance advancing container according to the first embodiment, (a) a perspective view from the front, (b) a view from the front, (c) a side view, (d) a vertical section, (e) a side view from another angle, (f) a vertical section of (e), (g) a perspective view from the rear, and (h) a view from the rear.

As shown in FIG. 3, the bar member 34 has the threaded section 34*a* formed on the outer peripheral surface in the approximately middle part thereof other than the front and rear ends. Formed in the front end of the bar member 34 is a variant-shaped engaging part 34*b* to be mate with the sealing part 32 while a blank section 34*c* without any thread is formed in the rear end. The engaging part 34*b* is thin with respect to the axial direction, forming a roughly shield-like shape.

Figure 4:
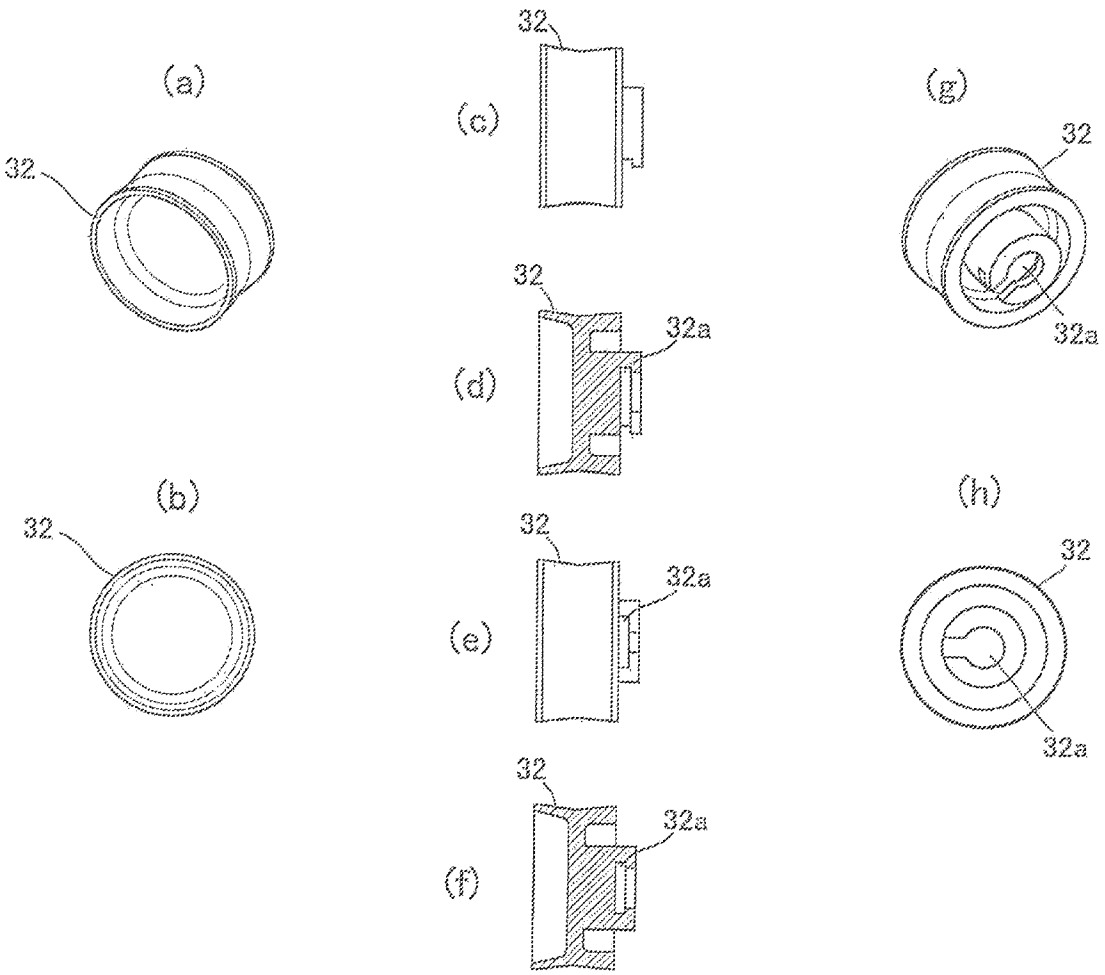
FIG. 4 is an illustrative diagram of a sealing part of the piston in the liquid substance advancing container according so the first embodiment, (a) a perspective view from the front, (b) a view from the front, (c) a side view, (d) a vertical section, (e) a side view from another angle, (f) a vertical section of (e), (g) a perspective view from the rear, and (h) a view from the rear.

The sealing part 32 is formed in a shape of rotational body like an approximate chalice or wheel as shown in FIG. 4. The outer peripheral surface is formed so that the front and rear ends are greater in diameter than the middle part while two strips formed along with a circumferential direction are formed on the outer peripheral surface as sealing surfaces that slide in contact with the interior wall of the reservoir 12 of the barrel body 10. The sealing part 32 has an engaged part 32*a* projected cylindrically rearward from the hub-like portion in the interior portion thereof.

This engaged part 32*a* forms an engagement structure such as a latch or the like in which a slit is formed on the side surface of the projected cylindrical part. The engaging part 34*b* (shown in FIG. 3) of the bar member 34 is inserted from the slit and fixed therein, whereby the sealing part 32 and bar member 34 are fixed with respect to the rotational direction and the front-to-rear direction, forming the integrated piston 18 that moves forward and backward.

Figure 5:
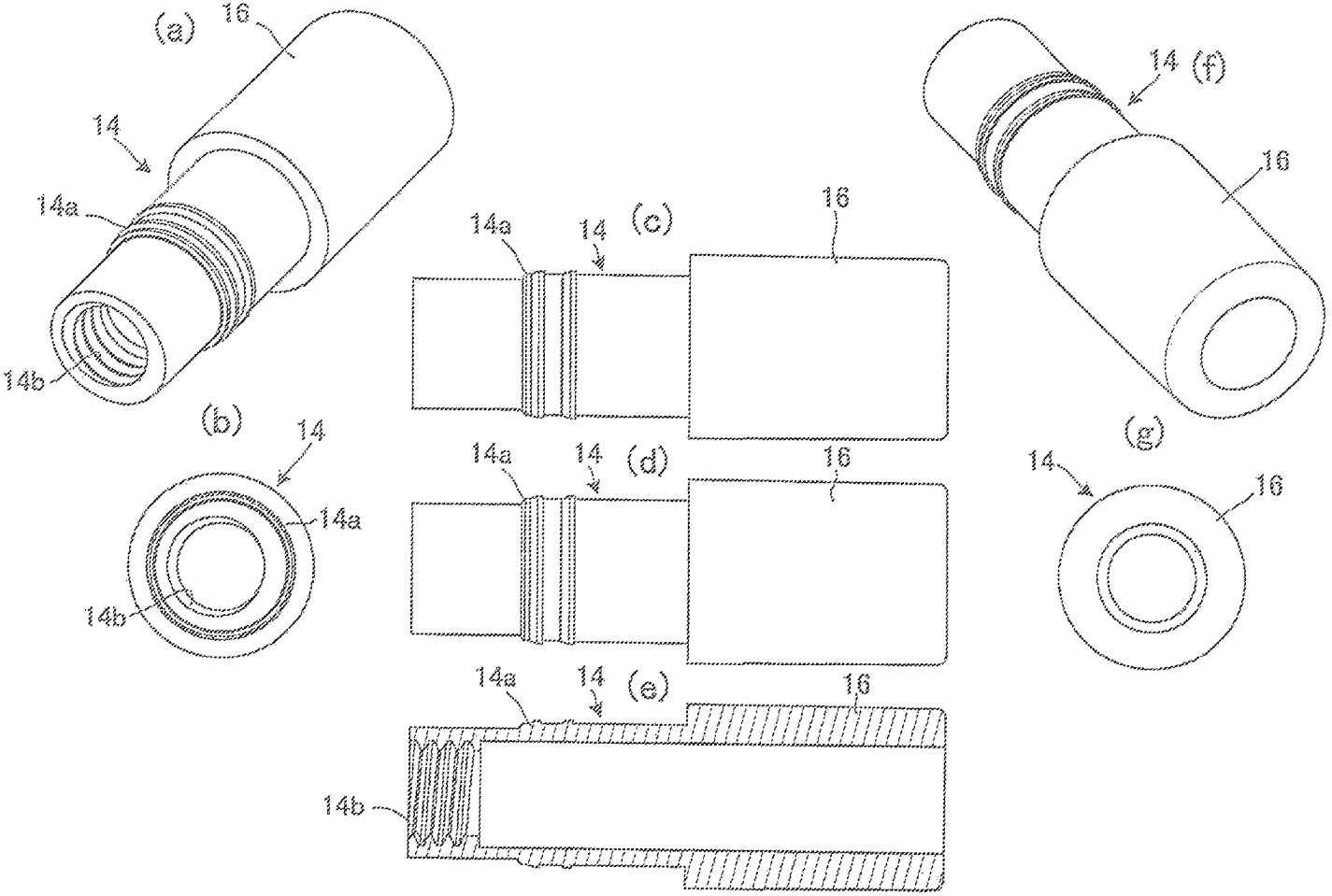
FIG. 5 is an illustrative diagram of a rotational body of the liquid substance advancing container according to the first embodiment, (a) a perspective view from the front, (b) a view from the front, (c) a side view, (d) a side view from another angle, (e) a vertical section of (d), (f) a perspective view from the rear, and (g) a view from the rear.

As shown in FIG. 5, the rotational body 14 is an approximate hollow cylinder and the outer peripheral of the rotational body has the rear part greater in diameter than the front part. The rotational body 14 forms the handle 16 the user can hold and rotate. Further, an annular rib is formed on the outer peripheral surface of the front part as a fitting part 14*a* so that the rotational body is rotatable relative to but will not slip off from the barrel body 10. The female threaded section 14*b* is formed in the front part on the inner peripheral surface of the rotational body 14.

Further, the bar member 34 in the rear part of the piston 18 can move together in the front-and-rear direction with the sealing part 32 relative to the inner wall of the reservoir 12 and is restricted in the rotational direction.

The outer peripheral surface of the sealing part 32 in the front part of the piston 13 can slider in contact with the inner wall of the reservoir 12 of the barrel body 10 and move in the axial direction of the barrel body 10 while the restriction of the piston 18 in the rotational direction is assured by the contact friction so that the piston will not rotate easily. That is, the sealing part 32 in the front part of the piston 18 is adapted to come into sliding contact with the inner wall of the reservoir 12 of the barrel body 10 by providing a suitable amount of interference to prevent the liquid content from leaking. The frictional force generated by the interference retains the piston so as not to rotate easily in the circumferential direction.

The piston 18 and other parts are molded of resin. The amount of interference is adjusted by setting the dimensions of the moldings. Other than this, it is possible to prevent easy rotation by selecting the material.

The advancing operation of the liquid substance advancing container according to the first embodiment will be described.

The threaded section 34*a* of the bar member 34 fixed to the piston 18 is screw-fitted with the inner threaded section 38*b* or the front bar-like part 36 while the outer threaded section 38*a* of the front bar-like part 36 is screw-fitted with the threaded section 14*b* of the rotational body.

When unused, the piston 18 in the advancing container is located at the backward limit so as to maximize the volume of the reservoir 12.

When used, the handle 16 is held to turn the rotational body 14 relative to the barrel body 10. As the user operates to rotate the handle 10 relative to the barrel body 10, the bar member 34 of the piston 10 advances due to the aforementioned difference in sliding friction, hence the sealing part 32 and piston 18 move forward. When the bar member has advanced to some degree, the blank section 34*c* without threaded section 34*a* abuts the inner threaded section 38*b* of the front bar-like part 36, so that the bar member is fixed to the front bar-like part 36 and set in a locked state without any further advance. FIG. 2(*c*) shows the limit of advance.

A further rotation of the handle 16 causes the front bar-like part 36 located outside to go ahead relative to the rotational body 14 as shown in FIG. 2(*d*) and hence further advances the sealing part 32 because the outer male threaded section 38*a* is screw-fitted with the female thread 14*b* of the rotational body 14. Herein, when the blank section 38*c* of the threaded section 38 abuts the female thread 14*b* of the rotational body 14, the piston 18 will go no further, so that it is possible to prevent the piston from overgoing.

Because of the advancing process described above, the liquid substance advancing container is configured so that the bar member 34 of the piston 18 and the front bar-like part 36 can extend and retract relative to the rotational body 14 in multiple stages.

The present invention should not be limited to the configuration of the liquid substance advancing container according to the first embodiment, but can be modified in various ways.

A liquid substance advancing container according to the second embodiment of the present invention will be described with reference to FIGS. 7, 8 and 9. The same components with those in the first embodiment are allotted with the same reference numerals.

Figure 7:
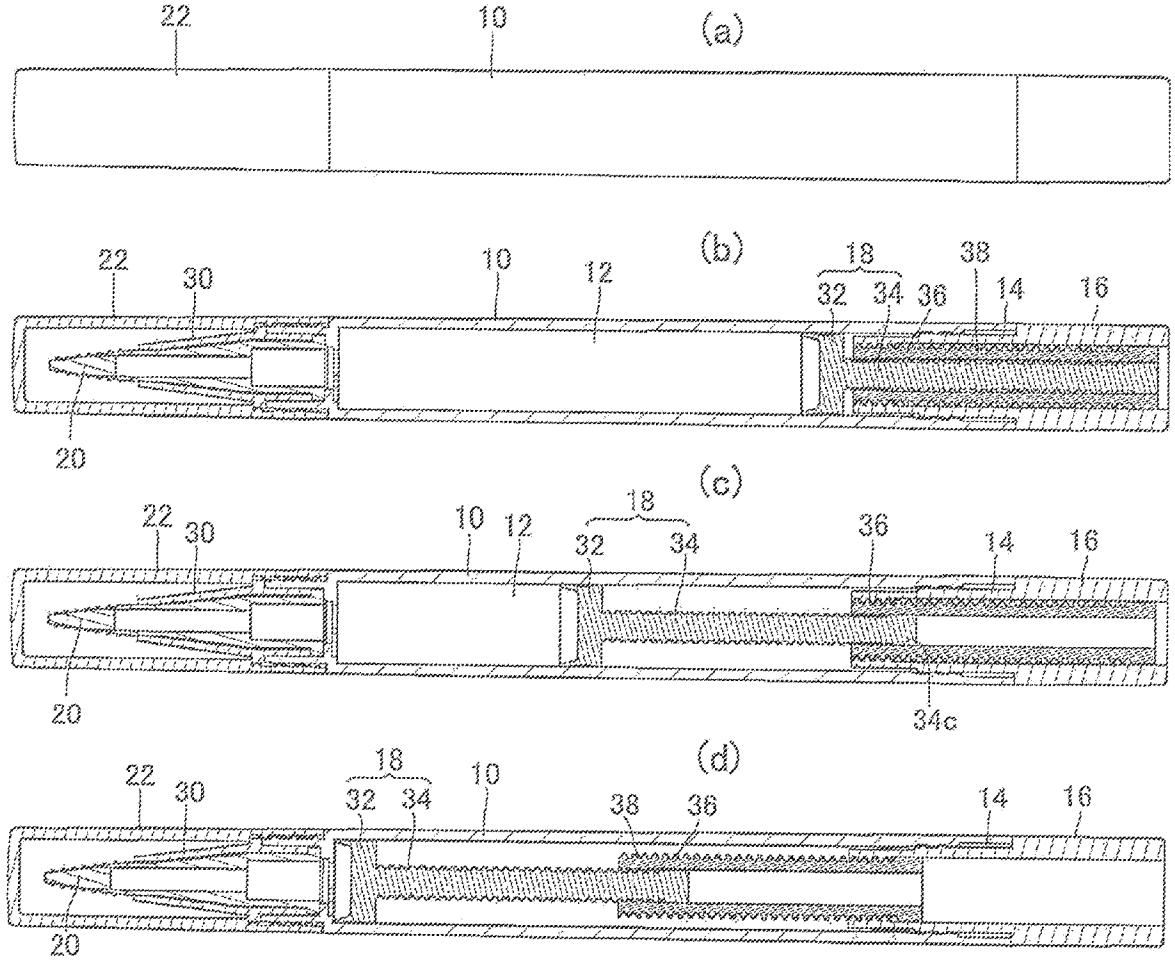
FIG. 7 is an illustrative diagram showing states of a liquid substance advancing container with a cap provided according to a second embodiment of the present invention, (a) a side view, (b) vertical section at the start of advancing, (c) vertical section during advancing and (d) vertical section at the end of advancing.
Figure 8:
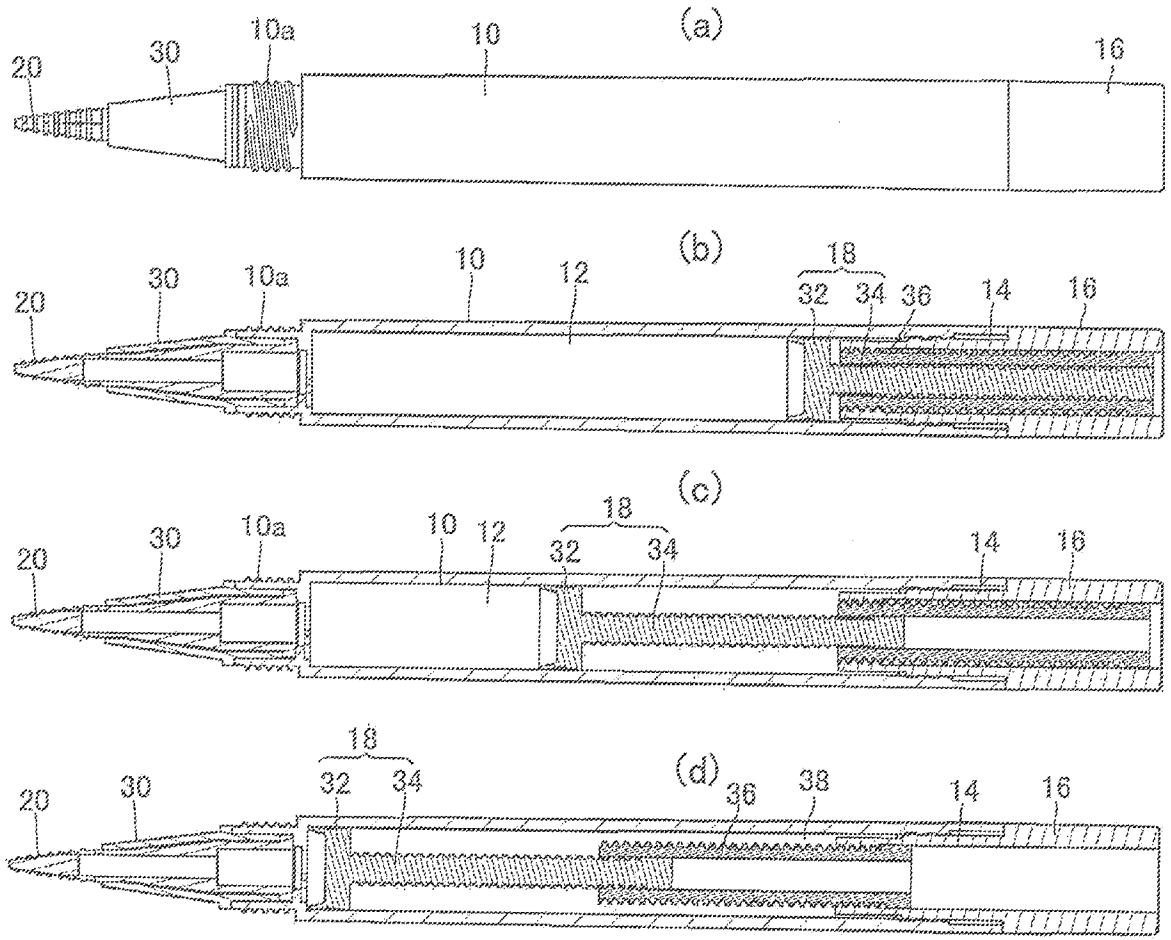
FIG. 8 is an illustrative diagram showing states of the liquid substance advancing container with the cap removed according to the second embodiment of the present invention, (a) a side view, (b) vertical section at the start of advancing, (c) vertical section during advancing and (d) vertical section at the end of advancing.
Figure 9:
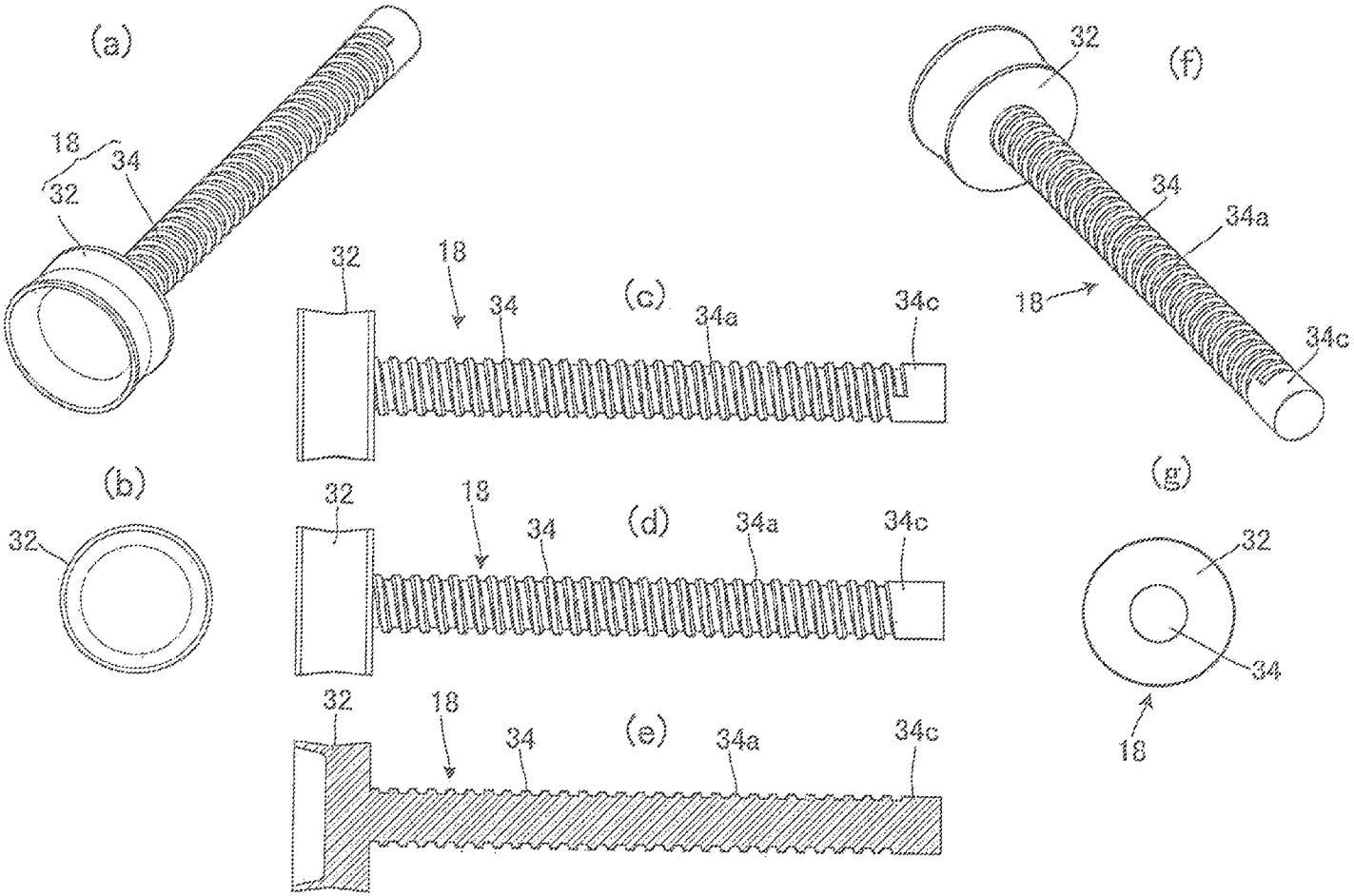
FIG. 9 is an illustrative diagram of a piston integrated with a sealing part and a bar-like part in the liquid substance advancing container according to the second embodiment, (a) a perspective view from the front, (b) a view from the front, (c) a side view, (d) a side view from another angle, (e) a vertical section of (d), (f) a perspective view from true rear, and (g) a view from the rear.

In this liquid substance advancing container, as shown in FIGS. 7 to 9 the piston 18 is molded of resin integrally with the sealing part 32 in the front and the bar member 34 in the rear. Since the bar member 34 having a threaded section on the outer periphery is integrated, the bar member is arranged to be movable in the axial direction and restricted in the rotational direction in the same manner as the piston 18. Similarly to the first embodiment, the blank section 34*c* is not threaded, in order to assemble the piston into the front bar-like part 36, the female thread 38*b* may be formed with silts for separation, the blank section 31*c* may be formed with slits, or the two may be formed with slits.

The applying part 20 has a roughly conical shape with a plurality of concentric disks (flanges) radially projected and arranged concentrically from the front end to the rear end at regular intervals. This applying part 20 is used to apply a liquid such as mascara or the like, and the projected part of disks forms a structure that enables easy application to cover the eyelashes with the liquid. The periphery of the applying part 20 is converted by the front barrel and inserted into the front end 10*a* of the barrel body 10.

Since in this liquid substance advancing container according to the second embodiment the piston 18 has a simple integrated configuration, it is possible to reduce the number of assembly steps compared to the first embodiment.

A liquid substance advancing container according to the third embodiment of the present invention will be described with reference to FIGS. 10 to 13. The same components with those in the first embodiment are allotted with the same reference numerals.

Figure 10:
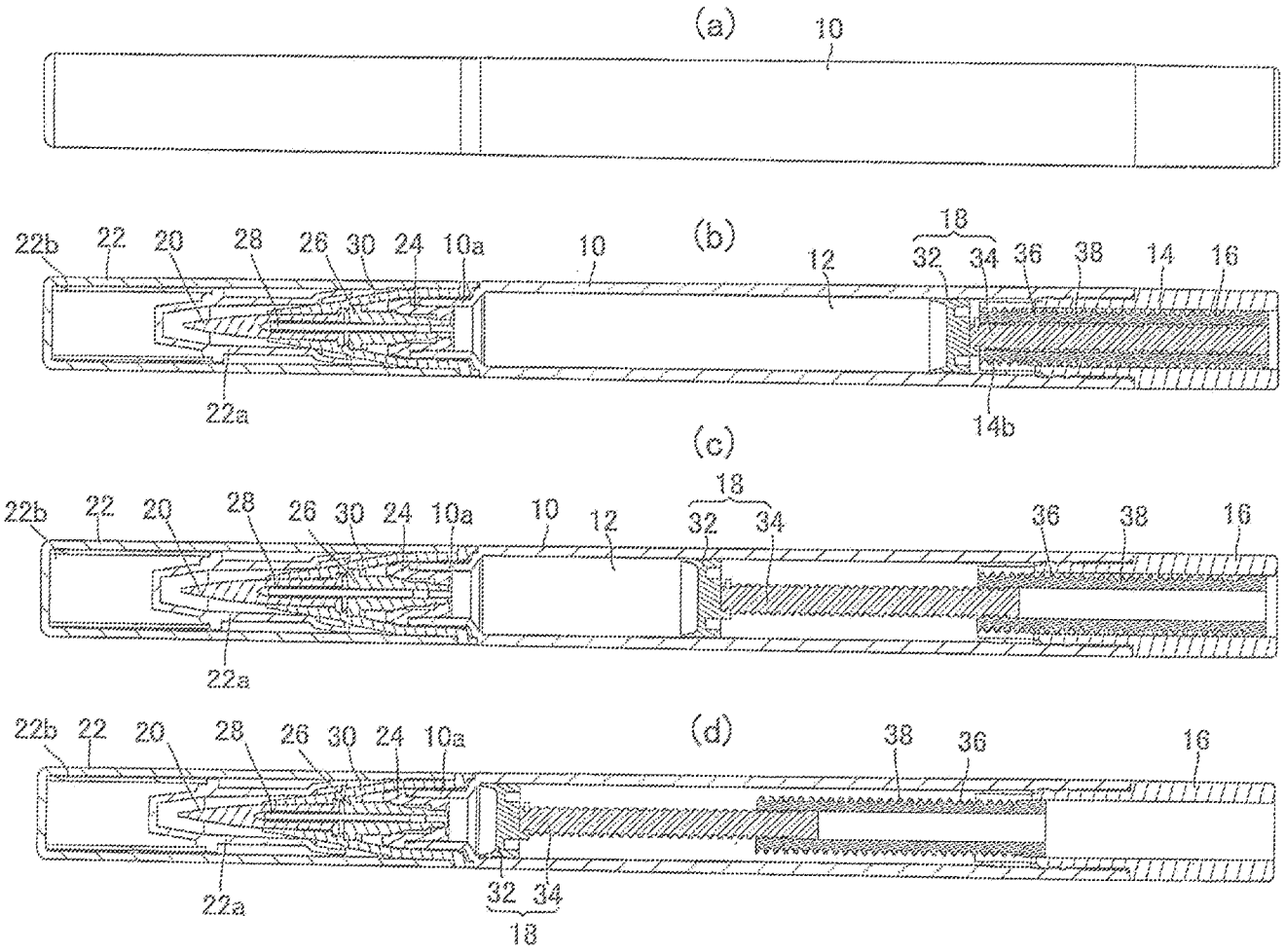
FIG. 10 is an illustrative diagram showing states of a liquid substance advancing container with a cap provided according to a third embodiment or the present invention, (a) a side view, (b) vertical section at the start of advancing, (c) vertical section during advancing and (d) vertical section at the end of advancing.
Figure 11:
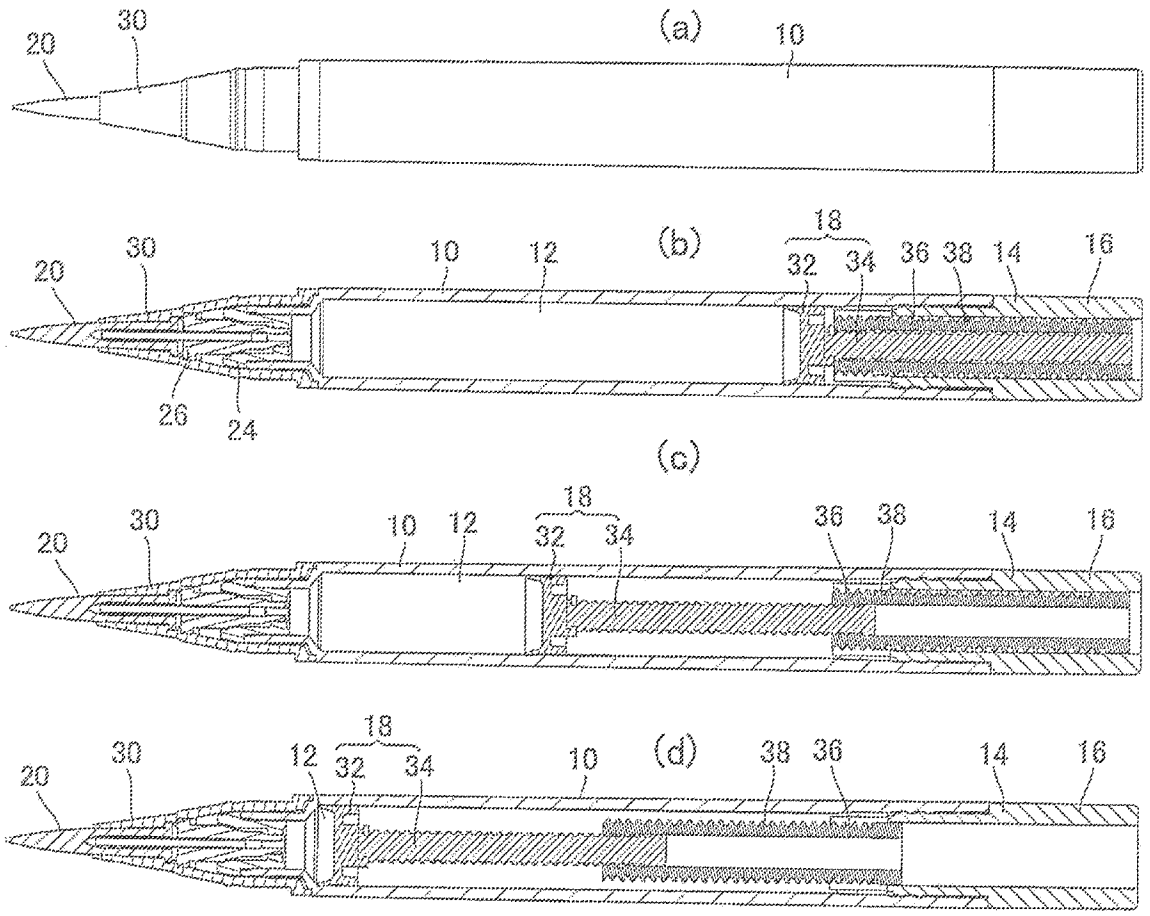
FIG. 11 is an illustrative diagram showing states of the liquid substance advancing container with the cap removed according to the third embodiment of the present invention, (a) a side view, (b) vertical section at the start of advancing, (c) vertical section during advancing and (d) vertical section at the end of advancing.
Figure 12:
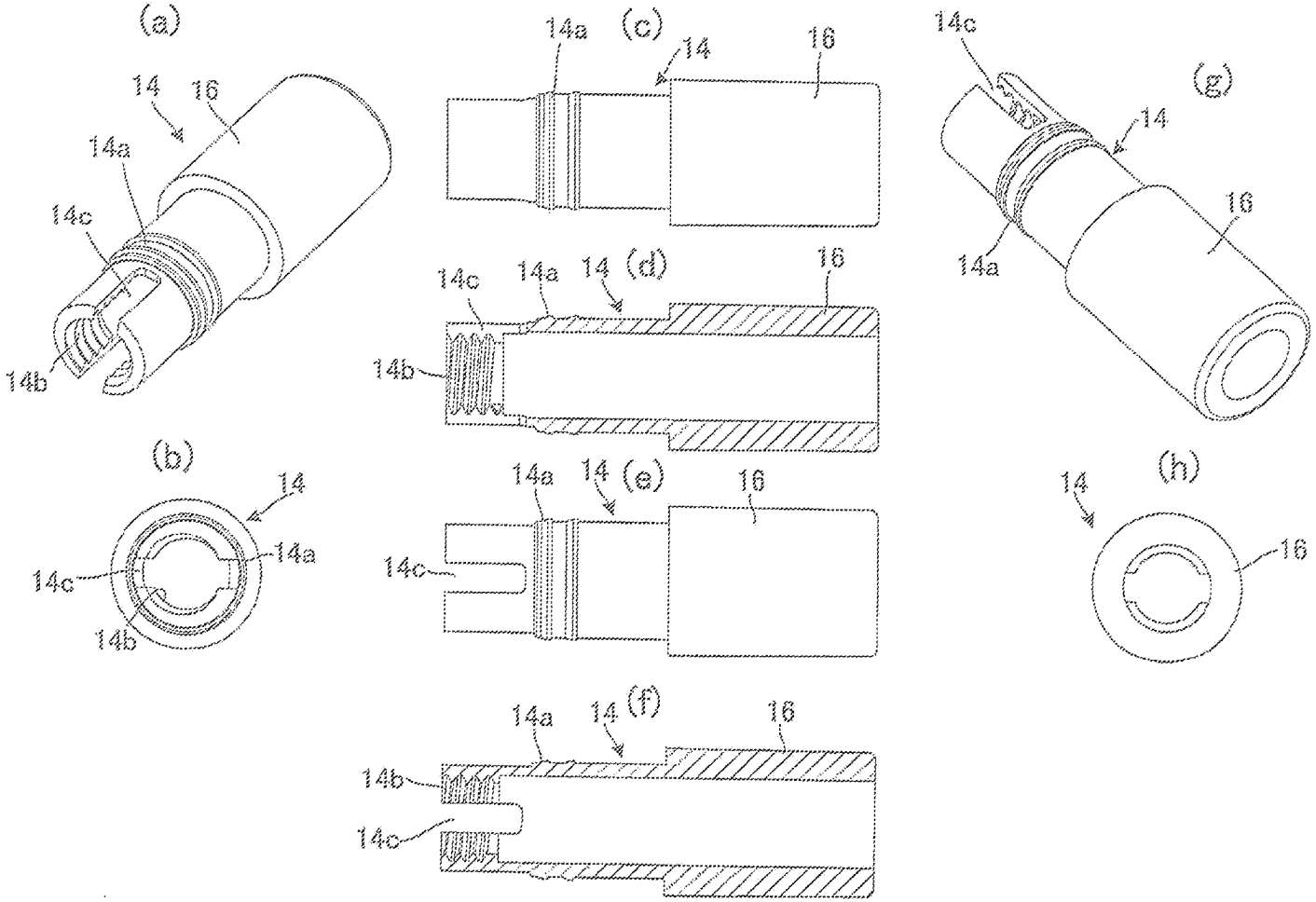
FIG. 12 is an illustrative diagram or a rotational body with silts formed in the liquid substance advancing container according to the third embodiment, (a) a perspective view from the front, (b) a view from the front, (c) a side view, (d) a vertical section, (e) a side view from an angle different from (c), (f) a vertical section of (e), (g) a perspective view from the rear, and (h) a view from the rear.
Figure 13:
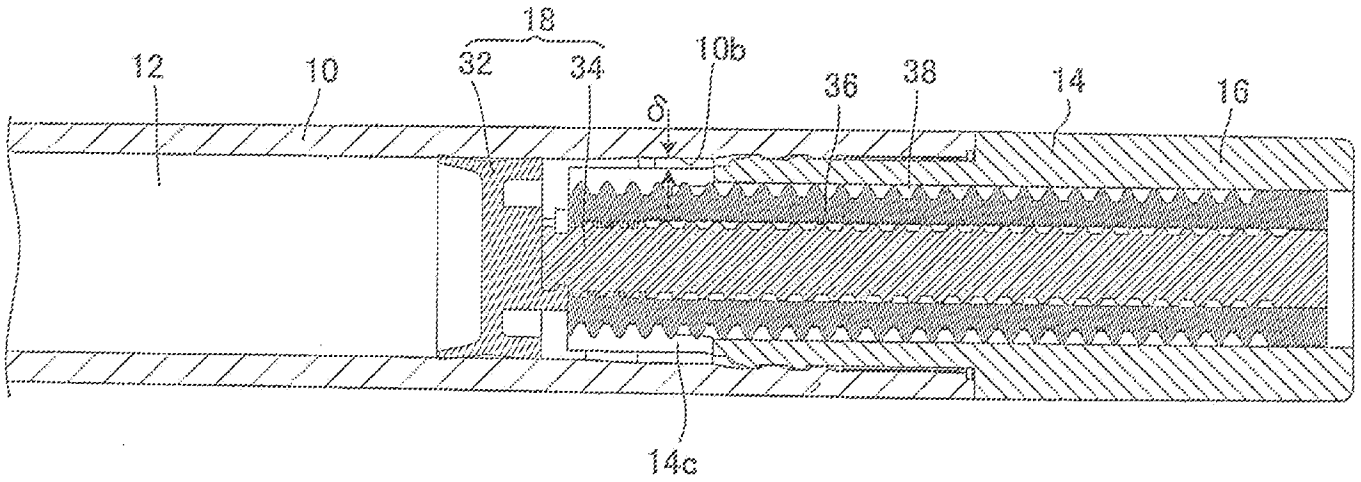
FIG. 13 is an illustrative diagram of the liquid substance advancing mechanism of the rotational body and front bar-like part and the like provided at the rear part of the barrel body for moving the piston forward in the liquid substance advancing container according to the third embodiment.

FIG. 10 shows unused states with the cap attached, FIG. 11 shows use states with the cap removed, FIG. 12 is an illustrative diagram of a rotational body, and FIG. 13 is an illustrative vertical sectional diagram of the rear part of the liquid substance advancing container.

In this liquid substance advancing container, the piston 18 has the same configuration where the sealing part 32 and the bar member 34 are joined in as in the first embodiment.

The cap 22 is fitted in the unused state as shown in FIG. 10, whereas the cap 22 is removed in the use state as shown in FIG. 11. FIGS. 10(*a*) and 11(*a*) show the state before the piston 18 is advanced. FIGS. 10(*b*) and 11(*b*) show the state during the piston 18 is being advanced. FIGS. 10(*c*) and 11(*c*) snow the state where the piston 18 has been advanced to the limit.

Herein, the rotational body 14 is an approximate hollow cylinder with the outer peripheral or the rear part greater in diameter than the front part, forming a handle 16 the user can hold and rotate, as shown in FIGS. 12 and 13. Further, an annular rib is formed on the outer peripheral surface of the front part as a fitting part 14*a* so that the rotational body is rotatable relative to but will not slip off from the barrel body 10. A female threaded section 14*b* is formed in the front part on the inner peripheral surface of the rotational body 14.

Slits that separate the threaded section are formed at one end of the front bar-like part and/or the rotational body 14. In the third embodiment, slits 14*c* are formed in the front of the handle 16 as a part of the rotational body 14 to separate the threaded section 14*b* that mates with the front bar-like part 36.

Specifically, two slits 14*c* located diametrically opposite positions are formed in the front part of the rotational body 14 so as to cut the threaded section 14*b* in the longitudinal direction from the front end to the rear.

Formation of these slits 14*c* allows the front part of the rotational body 14 to slightly open in diameter so that the front bar-like part 36 can be gently screwed in when the front bar-like part 36 is assembled. Alternatively, enlargement in diameter from the slits 14*c* makes it possible to press fit the front bar-like part 36 directly into the rotational body.

In the advancing mechanism, the slit 14*c* may be arranged in close proximity to the inner peripheral surface (designated by 10*b*) of the barrel body 10, as shown in FIG. 13. In the third embodiment, the clearance δ between the slit 14*c* and the inner peripheral surface 10*b* is specified to be 0.5 mm or smaller. This clearance can be specified as appropriate.

A liquid substance advancing container according to the fourth embodiment of the present invention will be described with reference to FIG. 14. The same components as those in the first embodiment will be allotted with the same reference numerals.

Figure 14:
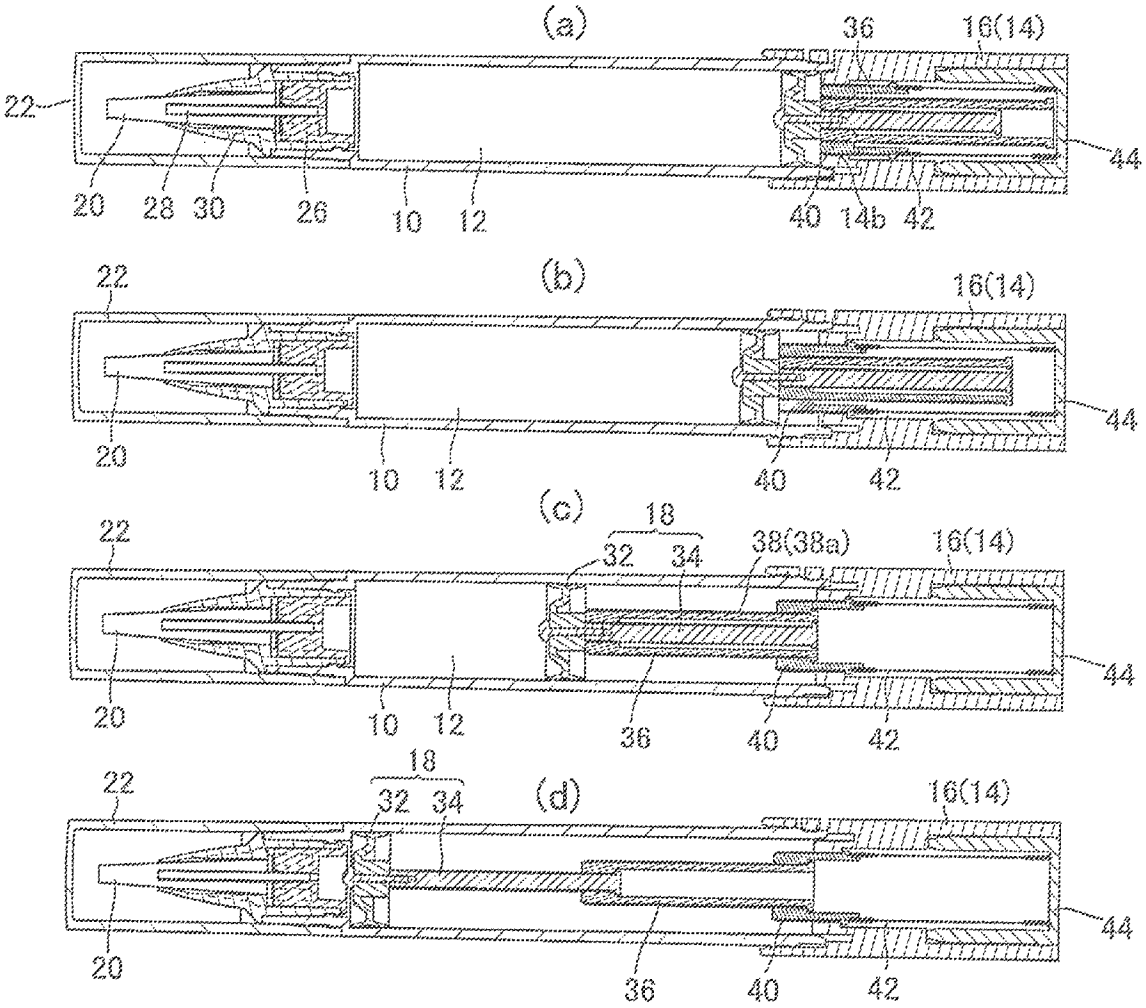
FIG. 14 is an illustrative diagram showing states of a liquid substance advancing container with a cap provided according to a fourth embodiment of the present invention, (a) vertical section at the start of advancing, (b) vertical section at the initial stage of advancing, (c) vertical section during advancing and (d) vertical section at the end of advancing.

As shown in FIG. 14, this liquid substance advancing container includes a rear sleeve 40 that is screw-fitted on the outer periphery of the front bar-like part 36 and screw-fitted into the inner periphery of the threaded section 14*b* of the rotational body 14.

An elastic part (spring) 42 is disposed between the front bar-like part 36 and the rotational body 14. Since this liquid substance advancing container is configured so that the elastic part 42 urges the front bar-like part 36 forward, the piston 18 can be moved forward not only by the advancing force resulting from the rotation of the rotational body 14 but also by the advancing force resulting from the pressing force of the elastic part 42 applied via the front bar-like part 36, as shown in FIGS. 14(*a*) to 14(*b*).

Specifically, in the fourth embodiment, in order to receive the rear end of the elastic part 42, a roughly cup-like sprint socket 44 that is open on the front side and closed on the rear side is provided inside the roughly cylindrical rotational body 14 to close the rear opening of the rotational body 14.

The rear sleeve 40 is arranged coaxially between the rotational body 14 and the front bar-like part 36. This rear sleeve 40 is formed with threads (female and male threads) on both the inner and outer peripheral surfaces. In the rear sleeve 40, a male thread is formed on the outer peripheral surface from the front to rear while the inner peripheral surface is reduced in diameter and formed with a female thread in the front part and stepped at the end of the female thread and enlarged in diameter with a flat interior surface without any threads.

The threaded section 14*b* on the inner periphery of the rotational body 14 is screw-fitted on the male thread of the outer peripheral surface of the rear sleeve 40 while the outer male thread 38*a* of cue trout bar-like part 36 is screw-fitted into the female thread on the inner peripheral surface of the rear sleeve 40. In this case, the piston 18 is formed by joining a front sealing part 32 to the front end of a rear bar member 34 by screw-fitting a screw penetrated through from the front. Here, the piston 18 may be formed by uniting the sealing part 32 and the bar member 34 as in the first embodiment shown in FIG. 1 and as in the third embodiment shown in FIG. 10. Alternatively, the piston may be integrally formed of the sealing part 32 and the bar member 34 as in the second embodiment shown in FIG. 8.

The rear part of the rear sleeve 40 is formed so as to be able to receive the elastic part (spring) 42 held in the spring socket 44 so as to press the rear sleeve 40 forward.

As shown in FIGS. 14(*a*) to 14(*b*), as the user starts rotating the rotational body 14, not only the advancing force of the rear sleeve 40 resulting from the rotational force but also the pressing force of the elastic part 42 acts on the rear sleeve 40 as the advancing force.

Accordingly, the rotational force of the rotational body 14 together with the elastic force of the elastic part 42 acts on the rear sleeve 40 as the advancing force so as to apply advancing force to the piston 18 via the front bar-like part 36 and move the piston 18 forward. When the flange-formed part on the outer periphery at the rear end of the rear sleeve 40 abuts the stepped portion in the inner periphery of the rotational body 14 so that the rear sleeve 40 reaches the forward limit, the rotational body becomes locked so as to turn the rear sleeve 40 as the rotational body 40 rotates.

Then, with the advancing operation of the rotational body 14, the rear sleeve 40 advances the front bar-like part 36 as shown in the same figure (c). When the front bar-like part 36 reaches the forward limit, the front bar-like part 36 starts rotating to advance the piston 18 via the bar member 34 as shown in the same figure (d).

Accordingly, in the liquid substance advancing container of the fourth embodiment, in the operation of advancing the piston 18, one pressing force from the elastic part 42 can be used together with the rotational force of the rotational body 14 to apply advancing torque to the piston 18. Particularly, because advance of the piston 18 by the rotational body 14 having a large outside diametric thread can be assisted, it is possible to deliver the application liquid with light rotational force. When the outside diameter of the thread of the rotational body 14 is made large without providing the rear sleeve 40 and the elastic part 42, the inside diameter of the threaded section 14*b* of the rotational body 14 and the outside diameter of the screw-fitted thread of the front bar-like part 36 become large, which requires large rotational force (torque) to turn the rotational body 14 for advancing action because sliding resistance between the screw-fitting threads becomes large. In contrast, in the fourth embodiment, since the advance of the piston is assisted by the urging force of the elastic part 42, it is possible to turn the rotational body 14 lightly.

Further, making the thread pitch greater enable quick advance of the content by a lower number of rotation when the user begins to use. Though the advancing operation requires a greater rotational force (torque) when the thread pitch is made greater, the liquid can be quickly delivered with light force because of assistance of the elastic part 42.

In the first to fourth embodiments having been described in the present invention, the bar member 34, front bar-like part 36 and rotational body 14 are used to advance the two-stage piston 18. However, it is possible to use multiple front bar-like parts to advance the piston by three or more stages.

Further, the male and female threads in the threaded sections of the Par member, front bar-like part and rotational body may be configured in other ways. For example, it is possible to provide a configuration in which the bar member is hollowed so as to have the front bar-like part screwed in while a male threaded rod from the rotational body is screwed into the front bar-like part.

INDUSTRIAL APPLICABILITY

Other than those for storing the fluid (liquid) cosmetics and chemicals, the liquid substance advancing container of the present invention may be used as one that stores a liquid substance such as mouthwash, medicine and the like in the reservoir and sends out the stored liquid substance to an applying part by turning the tail end for delivery operation.

DESCRIPTION OF REFERENCE NUMERALS

10 barrel body
10*a* front end
12 reservoir
14 rotational body
14*a* fitting part
14*b* threaded section
16 handle
18 piston
18*b* engaged part
20 applying part
22 cap
30 front barrel
32 sealing part
32*a* engaged part
34 bar member
34*a* threaded section
34*b* engaging part
34*c* blank section
36 front bar-like part
38 threaded section
38*a* outer male thread
38*b* inner female thread
40 rear sleeve
42 elastic part

The invention claimed is:

1. A liquid substance advancing container that stores a liquid content in a reservoir provided in a barrel body, moves a piston in the reservoir forward by turning a handle of a rotational body exposed from a rear end of the barrel body, relative to the barrel body, to advance the content to a front end of the barrel body, wherein the piston is formed of a sealing part in a front part of the piston that comes in sliding contact with an inner wall of the reservoir of the barrel body and a bar member in a rear part of the piston that has a threaded section on an inner periphery or an outer periphery, is movable in an axial direction and is restrained from moving with respect to a rotational direction, a front bar-like part extended forward from the handle is formed with a threaded section that is directly or indirectly screw-fitted to the threaded section of the bar member in the rear part of the piston, and, as the handle is rotated relative to the barrel body, the piston advances and then after full advance of the piston relative to the front bar-like part the front bar-like part can begin to extend and retract by multiple stages.

2. The liquid substance advancing container according to claim 1, wherein the bar member in the rear part of the piston together with the sealing part is movable in a front to rear direction and restrained from moving in an rotational direction, relative to the inner wall of the reservoir, and, an outer peripheral surface of the sealing part in the front part of the piston that comes into sliding contact with the inner wall of the reservoir of the barrel body, is movable in the axial direction and is retained by a frictional force so as not to easily rotate in the rotational direction.

3. The liquid substance advancing container according to claim 2, wherein the piston makes the sealing part in the front part of the piston come into sliding contact with the inner wall of the reservoir of the barrel body with an appropriate amount of interference in order to prevent leakage of the liquid content, and is retained by the frictional force generated by the interference so as not to easily rotate in a circumferential direction.

4. The liquid substance advancing container according to claim 1, wherein a blank section with no thread is provided in any one end of the bar member and the front bar-like part in which threaded sections thereof are screw-fitted to each other.

5. The liquid substance advancing container according to claim 1, wherein a slit that separates the threaded section of the front-bar like part is formed in one end of the front bar-like part and/or the slit is formed one end of the rotational body.

6. The liquid substance advancing container according to claim 5, wherein the slit is only formed in one end of the front bar-like part.

7. The liquid substance advancing container according to claim 5, wherein the slit is only formed in one end of the rotational body.

8. The liquid substance advancing container according to claim 5, wherein the slit is formed in close proximity to the inner peripheral surface of the barrel body.

9. The liquid substance advancing container according to claim 1, wherein an elastic part is provided between the rotational body and the front bar-like part.

10. The liquid substance advancing container according to claim 1, wherein a sliding friction between the bar member and the front bar-like part is smaller than a sliding friction between the front bar-like part and the rotational body.

* * * * *